US008215603B2

(12) United States Patent
Puleo

(10) Patent No.: US 8,215,603 B2
(45) Date of Patent: Jul. 10, 2012

(54) TREE STAND

(76) Inventor: Richard Puleo, Watchung, NJ (US)

( * ) Notice: Subject to any disclaimer, the term of this patent is extended or adjusted under 35 U.S.C. 154(b) by 274 days.

(21) Appl. No.: 12/381,975

(22) Filed: Mar. 18, 2009

(65) Prior Publication Data

US 2009/0302186 A1 Dec. 10, 2009

Related U.S. Application Data

(60) Provisional application No. 61/070,001, filed on Mar. 19, 2008.

(51) Int. Cl.
*F16M 13/00* (2006.01)

(52) U.S. Cl. ..... 248/528; 248/519; 248/529

(58) Field of Classification Search ..... 248/519, 248/528, 529, 511
See application file for complete search history.

(56) References Cited

U.S. PATENT DOCUMENTS

| | | | | |
|---|---|---|---|---|
| 2,482,979 | A | | 9/1949 | Isakson |
| 2,706,609 | A | | 4/1955 | Sullivan |
| 3,387,808 | A | | 6/1968 | Metcalf |
| 3,637,179 | A | | 1/1972 | Marschak |
| 4,032,098 | A | | 6/1977 | Marschak |
| 4,159,096 | A | | 6/1979 | Chase |
| 4,169,625 | A | | 10/1979 | Petersen |
| 4,288,052 | A | | 9/1981 | Scott |
| 4,406,437 | A | | 9/1983 | Wright |
| 4,712,758 | A | | 12/1987 | Cuschera |
| 4,763,866 | A | * | 8/1988 | Sinchok ..... 248/188.7 |
| 4,801,123 | A | | 1/1989 | Lynch |
| 5,022,620 | A | | 6/1991 | Scott |
| D342,694 | S | * | 12/1993 | Frost ..... D11/130.1 |
| 5,871,185 | A | | 2/1999 | Phillips et al. |
| 5,901,525 | A | * | 5/1999 | Doeringer et al. ..... 52/835 |
| 6,138,977 | A | | 10/2000 | Tsai |
| 6,293,512 | B1 | * | 9/2001 | Ho ..... 248/579 |
| 7,775,203 | B1 | * | 8/2010 | Patrick ..... 126/38 |
| 2005/0121591 | A1 | * | 6/2005 | Tsai ..... 248/523 |

* cited by examiner

*Primary Examiner* — Amy J Sterling
(74) *Attorney, Agent, or Firm* — Brian K. Johnson, Esq., LLC.

(57) ABSTRACT

The present invention relates to a tree stand having a first stand section including a central tube, the central tube having a first circumference, the central tube of the first stand section having at least one leg affixed to the tube, the leg having a u-shaped slot at an end of the leg proximate to the tube; and a second stand section including a central tube having a second circumference, the second circumference being larger than the first circumference, the central tube of the second section having at least one leg affixed to the tube, the central tube of the second section having a pin in corresponding relationship with the u-shaped slot on the leg of the first stand section such the slot is disposed over the pin when the tube portion of the first stand section is slid over the tube portion of the second stand section to create the stand.

6 Claims, 2 Drawing Sheets

TREE STAND

CROSS-REFERENCES TO RELATED APPLICATIONS

This application claims priority under 35 USC §119(e) to U.S. Provisional Patent Application Ser. No. 61/070,001 filed on Mar. 19, 2008, entitled TREE STAND, the disclosure and application of which is incorporated by reference herein in its entirety.

FIELD OF THE INVENTION

The present invention relates to a tree stand, and more particularly to multipart, interlocking structures that insert into one another to provide a sturdy, stable stand for supporting a Christmas Tree. These improved tree stands are capable of quick and relatively effortless disassembly in order to simplify packaging, shipping and storage of the stands.

BACKGROUND OF THE INVENTION

Numerous designs have been provided for Christmas Tree stands of varying design and utility. Many of these are composed of a plurality of components that are assembled to provide for the final stand construction.

U.S. Pat. No. 6,138,977 issued to Tsai discloses a tree pedestal that includes a main body and a secondary body wherein the main body forms an inner sleeve portion and a first outer sleeve portion, and the secondary body forms a second outer sleeve portion. The inner sleeve portion of the main body is received within the second outer sleeve portion of the secondary body whereby the main body and the secondary body are capable of being freely rotated over 90 degrees with regard to each other. The pedestal is capable of folding a plurality of first and second supporting legs of the main body and the secondary body together in a limited space for transportation, storage, delivery and packing thereof.

U.S. Pat. No. 6,293,512 issued to Ho discloses a collapsible support frame that is formed of an inner tube, an outer tube, and a plurality of support legs. The support legs are fastened to the inner tube and the outer tube. The inner tube is rotatably fitted into the outer tube. The folding and the unfolding of the support legs are attained by turning the inner tube at an angle. The inner tube has a hollow interior for holding a Christmas tree, a flag pole, and the like. The outer tube has a through hole formed in a wall thereof, and in a region of a bottom end of the wall. The inner tube is rotatably fitted into the outer tube. The inner tube has a stop portion formed at a top end of an outer wall thereof. The inner tube has a groove and a retaining slot extending from one end of the groove, the groove and the retaining slot being provided in a region of a bottom end of the inner tube. A plurality of support legs are fastened respectively to the outer tube and the inner tube. One of the support legs has a leg rod that extends through the through hole in said outer tube and into the groove of the inner tube. The support legs are unfolded by turning the inner tube relative to the outer tube such that the leg rod slides so as to be located in the retaining slot. The support legs are folded by lifting and turning the inner tube relative to the outer tube to cause the leg rod to move from the retaining slot and slide back to another end of the groove.

U.S. Pat. Appln. Pub. No. 2005/0121591 having an inventor Tsai discloses a Christmas tree stand that comprises a main frame including a main tube having upper and lower shoulders and a pair of first supporting legs. An auxiliary frame is configured with first and lower collars which can be enveloped onto the upper and lower shoulders. The auxiliary frame further includes a pair of second supporting legs. A bolt is provided to lock the auxiliary tube with respect to the main tube.

None of these designs, however, provide for a securely connected tree stand consisting of a minimal number of assembled parts where the parts are engaged by easily sliding them into one another such that they are in permanently locked arrangement once assembled.

SUMMARY OF THE INVENTION

In a particularly preferred aspect, the present invention for a stand includes a first stand section including a central tube, the central tube having a first circumference, the central tube of the first stand section having at least one leg affixed to the tube, the leg having a u-shaped slot at an end of the leg proximate to the tube; and a second stand section including a central tube, the central tube having a second circumference, the second circumference being larger than the first circumference, the central tube of the second section having at least one leg affixed to the tube, the central tube of the second section having a pin on an outer surface of said tube aligned in corresponding relationship with the u-shaped slot on the leg of the first stand section such that the slot is disposed over the pin when the tube portion of the second stand section is slid over the tube portion of the first stand section to create the stand. Improvements to this invention include a securing mechanism for fixing the radial position of the central tubes of the first and second stand sections; the securing mechanism being a screw; the first and second stand sections have two legs attached to each of the central tubes, each of the pair of legs of the sections disposed on opposite sides of the tubes; a plurality of u-shaped slots at ends of the legs of the first stand section and proximate to the tube of the first stand section, and a plurality of pins on the outer surface of the tubes of the section stand section aligned in corresponding relationship to the plurality of the u-shaped slots such that the slots are disposed over the pins when the tube portion of the first stand section is slid inside the tube portion of the second stand section to create the stand; and the pin being threaded and a nut being used to secure the u-shaped portion of the leg to the pin.

In another aspect of the present invention a stand is provided having a first stand section including a central tube, the central tube having a first circumference, the central tube of the first stand section having at least one leg affixed to the tube, the leg being connected to the tube along a portion of an external surface of the tube; and a second stand section including a central tube, the central tube having a second circumference, the second circumference being larger than the first circumference, the central tube of the second section having at least one leg affixed to the tube, the central tube of the second section having a slot in the central tube in corresponding relationship with the leg of the first stand section such that the leg of the first stand section is disposed within the slot in the central tube of the second stand section when the tube portion of the second stand section is slid over the tube portion of the first stand section to create the stand. Improvements of this invention include a securing mechanism for fixing the radial position of the central tubes of the first and second stand sections; the securing mechanism being a screw; and the first and second stand sections having two legs attached to each of the central tubes, each of the pair of legs of the sections disposed on opposite sides of the tubes. In another improved invention aspect, the stand further includes a plurality of legs affixed to the tube of the first stand section, the legs being connected to the tube along a portion of an external surface of the tube, and a plurality of slots on the tube of the second stand section in corresponding relationship to the plurality of the legs such that the legs of the first stand section are disposed within the slots in the central tube of the second stand section when the tube portion of the second stand section is slid over the tube portion of the first stand section to create the stand.

In another aspect of the present invention, a stand is provided that includes a central stand section including a central tube, the central tube of the central stand section having at least one leg affixed to the tube, the central stand section having at least one channel disposed along a surface of the tube; and a leg section having a slide portion the slide portion of the leg slide disposed within the channel in the tube of the central stand section to create the stand. Further the improvements of this invention include the channel being disposed on an external surface of the central tube along an axis of the tube; a securing mechanism for fixing the radial position of the central tubes of the first and second stand sections and the securing mechanism being a screw.

In another aspect of the invention, a stand is provided comprising a first stand section including a central tube, the central tube having a first circumference, the central tube of the first stand section having at least one leg affixed to the tube, the leg having a pin at an end of the leg proximate to the tube; and a second stand section including a central tube, the central tube having a second circumference, the second circumference being larger than the first circumference, the central tube of the second section having at least one leg affixed to the tube, the central tube of the second section having an insertion cylinder on an outer surface of the tube aligned in corresponding relationship with the pin on the leg of the first stand section such that the pin is disposed within the insertion cylinder when the tube portion of the second stand section is slid over the tube portion of the first stand section to create the stand.

DETAILED DESCRIPTION OF THE INVENTION

A detailed description of the present invention will be shown below with reference to the figures.

Figure 1A:
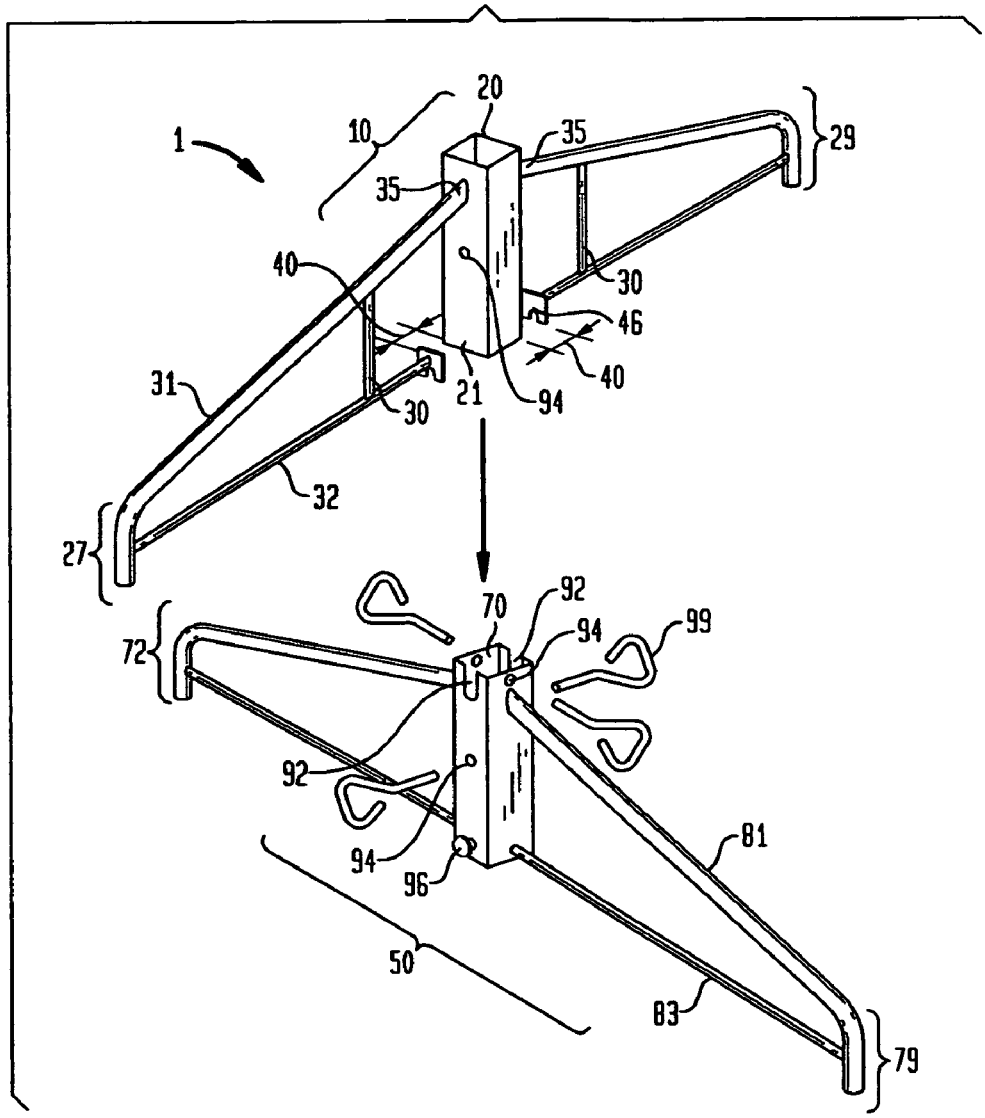
FIG. 1A is a tree stand according to one embodiment of the present invention.
Figure 1B:
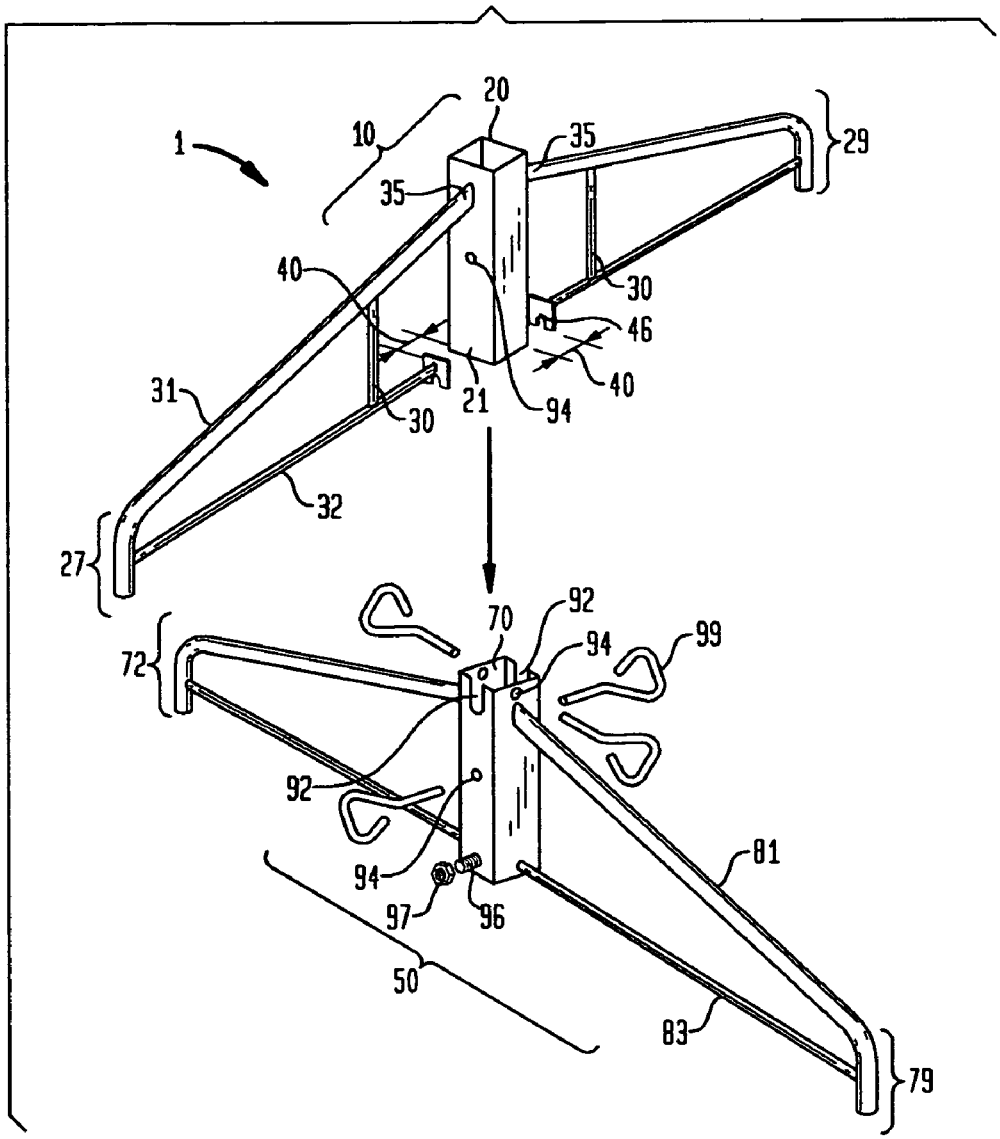
FIG. 1B is a tree stand according to another embodiment of the present invention.

In the following discussion, within both the specification and the claims directed thereto, references to tubes are made to indicate generally the tube-like portions of the invention. As shown explicitly in FIGS. 1A and 1B as square tubes, the recitation of tubes herein is not intended be limited to cylindrical structures. Likewise, corresponding references to circumferences and other dimensions of the tube-like structures are intended to have corresponding and commensurate meanings when used in reference to non-cylindrical tubes (i.e. the circumference of a square tube is really the measure of linear perimeter).

Referring to FIG. 1, a tree stand 1 is disclosed having a first stand section 10 and a second stand section 50. First stand section 10 includes a central tube portion 20 with legs 27, 29 attached to the central tube. The legs 27 and 29 are permanently attached at the top of central tube 20 and contain supporting leg structures 30 within the legs to fix the relationship of the top leg portion 31 to the bottom leg portion 32. A U-shaped slot 46 is provided on the bottom leg portion 32. A space 40 is left between the bottom leg portions 32 and the central tube 40 as defined by the outer surface 21 of the central tube and the bottom leg portion defining the U-shaped slot 46.

The tree stand of FIG. 1 further includes a second stand portion 50 having a central tube 70 with legs 77, 79 attached to the central tube. Top leg portion 81 and bottom leg portion 82 of the legs 77, 79 are permanently attached at both the top and bottom of central tube 70. Slots 92 are provided at the top edge of central tube 70. A pin 96 is provided on the bottom of central tube 70. Holes 94 are disposed throughout both central tubes 20 and 70 of the first and second stand portions respectively.

Upon assembly of the stand in FIG. 1, the central tube 70 of the second stand portion 50 is inserted over the central tube 20 of the first stand portion 10. To accommodate this, the circumference of central tube 70 is made to be larger than that of central tube 20. The central tube 70 fits between spaces 40 of the first stand portion upon insertion. In the final assembled position of the stand, leg portion 35 of top leg portion 31 of the legs of the first stand portion fit within the slots 92 at the top of central tube 70. Also, U-shaped slot 46 is slide down alongside the outer surface of central tube 70 and engage pins 96 to form a secure relationship thereto. Screws or eye rings 99 may be inserted into holes 94, which may be threaded, to further secure the final assembled relationship of the first and second stand portions 10 and 50.

In one particularly preferred embodiment, the stand portions are made of metal, e.g. tubular steel, and the legs of each of the two stand sections are permanently affixed to the central tubes of those sections by welding them together. In another particularly preferred embodiment, the pins 96 are threaded so as to receive a wing nut or other threaded securing means 97 which is screwed down on the pin to secure the frame portion defining the U-shaped slots to the second stand portion. Alternatively, pins 96 may also include an end knob or T-shaped end to assist in retaining the U-shaped slot.

Referring to FIG. 2, a tree stand 100 is disclosed having a first stand section 110 and a second stand section 150. First stand section 110 includes a central tube portion 120 with legs 127, 129 attached to the central tube. The top leg portions 131 of legs 127 and 129 are permanently attached at the top of central tube section and the bottom leg portion 132 are permanently attached at a central location 135 along central tube section 120.

The tree stand of FIG. 2 further includes a second stand portion 150 having a central tube 170 with legs 177, 179 attached to the central tube. Top leg portion 181 and bottom leg portion 182 of the legs 177, 179 are permanently attached at both the top and bottom of central tube 170. Slots 192 are provided at the top edge of central tube 170. Holes 194 are disposed throughout both central tubes 120 and 170 of the first and second stand portions respectively.

Upon assembly of the stand in FIG. 2, the central tube 170 of the second stand portion 150 is inserted over the central tube 120 of the first stand portion 110. To accommodate this, the circumference of central tube 170 is made to be larger than that of central tube 120. In the final terminal assembled arrangement of the stand, leg portion 135 of bottom leg portion 132 of the legs of the first stand portion fit within the slots 192 at the top of central tube 170. Screws or eye rings 199 may be inserted into holes 194, which may be threaded, to further secure the final assembled relationship of the first and second stand portions 110 and 150.

Referring to FIG. 3, a tree stand 200 is disclosed having a first stand section 210 and insertable legs sections 250 and 251. Stand section 210 includes a central tube portion 220 with legs 227, 229 attached to the central tube. The top and bottom leg sections 281 and 282 of the leg sections are permanently attached at to the central tube section 220. Central tube portion 220 has disposed on its outer surface engagable slide supports 292 for receiving slideable inserted portions of leg sections 250 and 251.

The leg sections 250 and 251 of tree stand further include at least one slideable portion 246 attached to both an upper leg portion 231 and a lower leg portion 232. In one particularly preferred embodiment, slideable portion 246 is a relatively flat surface that is configured for insertable engagement into slide support 292.

Upon assembly of the stand in FIG. 3, the leg portions 250 and 251 are slideable inserted into slide supports 292 to form the final stand. In the final assembled arrangement of the stand, screws or eye hooks 299 may be inserted into holes 294, which may be threaded, to further secure the final assembled relationship of the leg portions 250 and 251 and the stand section 210.

Referring to FIG. 4, a tree stand 300 is disclosed that is very similar to that showed in FIG. 1 with the following difference. Instead of the U-shaped slot on an end portion of the bottom leg portion, a space 340 is left between the bottom leg portions 332 and the central tube 340 and the end portion of bottom leg portion 332 is extended downward to create an insertion pin 346. Complementary wise, an insertion cylinder 396 is provided on the bottom of central tube 370.

Upon assembly of the stand in FIG. 4, the central tube 370 of the second stand portion 350 is inserted over the central tube 320 of the first stand portion 310. To accommodate this, the circumference of central tube 370 is made to be larger than that of central tube 320. The central tube 370 fits between spaces 340 of the first stand portion upon insertion. In the final assembled position of the stand, leg portion 335 of top leg portion 331 of the legs of the first stand portion fit within the slots 392 at the top of central tube 370. Also, insertion pin 346 is slid down alongside the outer surface of central tube 370 and into insertion cylinder 396 to form a secure relationship thereto. Screws or eye rings 399 may be inserted into holes 394, which may be threaded, to further secure the final assembled relationship of the first and second stand portions 310 and 350.

While certain embodiments of the present invention have been disclosed herein, those of skill in art will recognize that alternatives and variations to the present invention are possible that do not alter the basic nature of the invention.

What is claimed is:

1. A stand comprising:

a first stand section including a central tube, said central tube having a first circumference, said central tube of said first stand section having at least one leg affixed to said tube, said leg having a u-shaped slot at an end of said leg proximate to said tube; and a second stand section including a central tube, said central tube having a second circumference, said second circumference being larger than said first circumference, said central tube of said second section having at least one leg affixed to said tube, said central tube of said second section having a pin on an outer surface of said tube aligned in corresponding relationship with said u-shaped slot on said leg of said first stand section such that said slot is disposed over said pin when said tube portion of said second stand section is slid over said tube portion of said first stand section to create said stand.

2. The stand of claim 1 further comprising a securing mechanism for fixing the radial position of said central tubes of said first and second stand sections.

3. The stand of claim 2 wherein said securing mechanism is a screw.

4. The stand of claim 1 wherein said first and second stand sections have two legs attached to each of said central tubes, each of said pair of legs of said sections disposed on opposite sides of said tubes.

5. The stand of claim 1 further comprising a plurality of u-shaped slots at ends of said legs of said first stand section and proximate to said tube of said first stand section, and a plurality of pins on said outer surface of said tubes of said second stand section aligned in corresponding relationship to said plurality of said u-shaped slots such that said slots are disposed over said pins when said tube portion of said first stand section is slid inside said tube portion of said second stand section to create said stand.

6. The stand of claim 1 wherein said pin is threaded and a nut is used to secure said u-shaped portion to said pin.

* * * * *